United States Patent [19]

Pitozzi

[11] Patent Number: 4,501,237

[45] Date of Patent: Feb. 26, 1985

[54] CONTROL UNIT FOR THE LUBRICATING OIL CIRCULATION PUMP AND FOR THE FUEL INJECTION SYSTEM REGULATOR OF DIESEL ENGINES

[75] Inventor: Luigi Pitozzi, Brescia, Italy

[73] Assignee: SAME S.p.A., Treviglio, Italy

[21] Appl. No.: 514,708

[22] Filed: Jul. 18, 1983

[30] Foreign Application Priority Data

Jul. 16, 1982 [IT] Italy ..... 22420/82[U]

[51] Int. Cl.[3] ..... F02M 1/00

[52] U.S. Cl. ..... 123/196 W; 123/508; 123/474; 123/198 C; 184/6.28

[58] Field of Search ..... 123/196 W, 195 A, 195 R, 123/198 C, 508, 364, 357, 474; 184/6.28

[56] References Cited

U.S. PATENT DOCUMENTS

| | | | |
|---|---|---|---|
| 3,587,540 | 6/1971 | Hofmann | 123/357 |
| 4,014,301 | 3/1977 | Happel | 123/474 |

FOREIGN PATENT DOCUMENTS

| | | | |
|---|---|---|---|
| 1254775 | 11/1971 | United Kingdom | 123/195 A |
| 1365805 | 9/1974 | United Kingdom | 123/195 A |

*Primary Examiner*—E. Rollins Cross

*Attorney, Agent, or Firm*—Stevens, Davis, Miller & Mosher

[57] ABSTRACT

A control unit for the lubricating oil circulation pump and for the fuel injection system regulator of diesel engines, comprising a shaft extending through the cylinder block from the oil sump to said regulator, which is mounted externally, said shaft being operationally connected at an intermediate point thereof to the engine cam shaft, and at its opposing ends to the power take-offs of said circulating pump and regulator respectively.

2 Claims, 2 Drawing Figures

CONTROL UNIT FOR THE LUBRICATING OIL CIRCULATION PUMP AND FOR THE FUEL INJECTION SYSTEM REGULATOR OF DIESEL ENGINES

Diesel engines are known comprising separate controls for the lubricating oil circulation pump and for the fuel injection system regulator.

The object of the present invention is to provide a control unit which is able to simultaneously operate both the lubricating oil circulation pump and the diesel injection system regulator, said regulator being a self-contained device mounted externally to the engine and easily interchangeable.

The said control unit can also comprise a power take-off for mechanical tachometers.

This object is attained according to the invention by providing, in a diesel engine, a control unit comprising a shaft extending through the cylinder block from the oil sump to the fuel injection system regulator, said shaft being operationally connected at an intermediate point thereof to the engine cam shaft, and connected at its opposing ends to the power take-off of the lubricating oil circulation pump and of said regulator respectively.

The opposite end of the regulator shaft can drive a mechanical tachometer.

In this manner, a diesel engine is obtained which is of more economical construction, structurally compact, operationally reliable and of simple maintenance.

Figure 1:
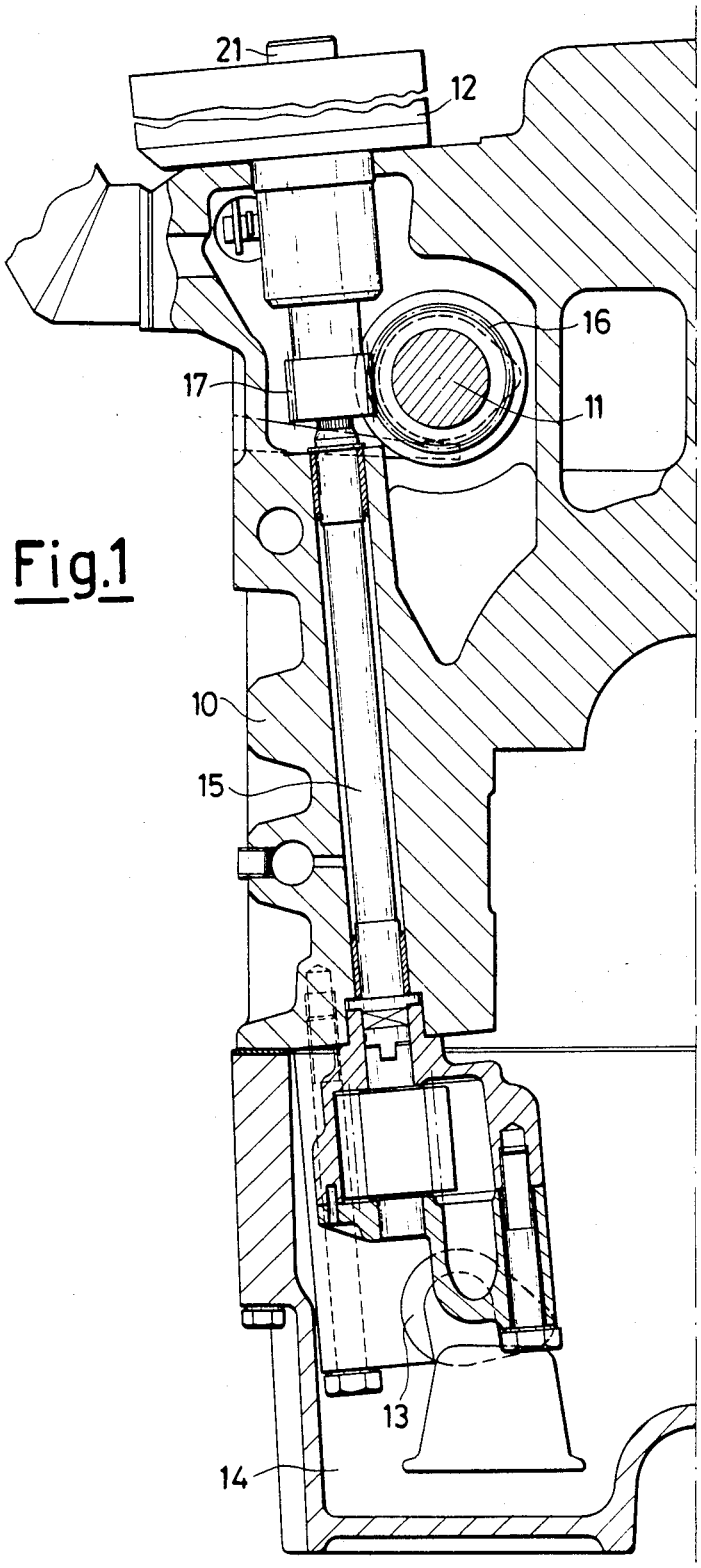
Figure 2:
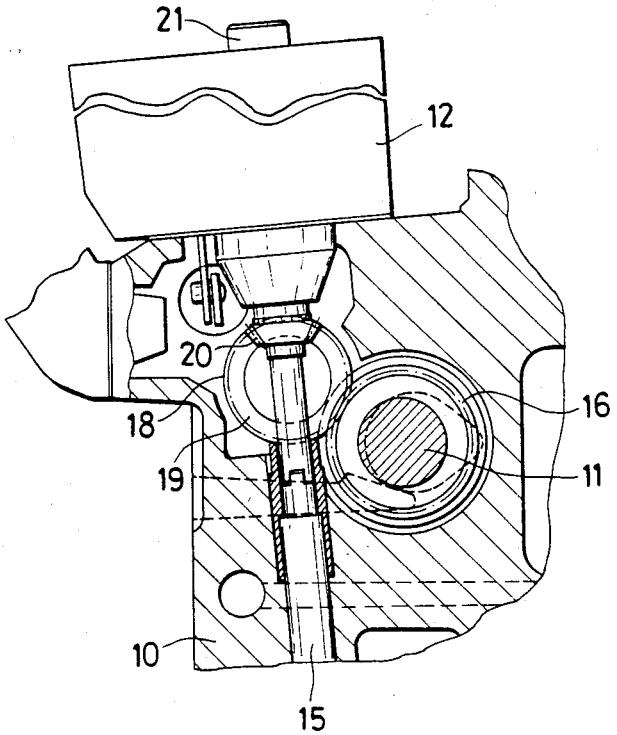

The structural and operational characteristics of the invention and its advantages will be more apparent from the description given hereinafter by way of example with reference to the accompanying drawings, on which:

FIG. 1 is a section showing part of the cylinder block of a diesel engine incorporating a control unit constructed in accordance with the present invention, and FIG. 2 is a detail.

On the drawings, the reference numeral 10 indicates a diesel engine cylinder block, 11 the cam shaft, 12 the fuel injection pump regulator, and 13 the circulation pump for the lubricating oil collected in the sump 14.

The possible power take-off for a mechanical tachometer is indicated at the point 21.

According to the present invention, the regulator 12 and pump 13 are controlled by a single shaft 15 which passes through the cylinder block 10 and is driven by the said cam shaft 11 by means of a pair of gears 16, 17 (FIG. 1), or by a gear train composed of two cylindrical gears (16,18, FIG. 2) and two bevel-gears (19, 20, FIG. 2).

At its opposing ends, the shaft 15 is operationally connected to the regulator 12 and pump 13 in any suitable manner.

The object stated in the introduction to the description is thus attained.

I claim:

1. A control unit for a lubricating oil circulation pump and for a fuel injection system regulator of a diesel engine of the type having a cylinder block in which an engine camshaft is rotatable, wherein said regulator is mounted on said cylinder block externally thereto and the unit comprises a control shaft extending through said cylinder block substantially perpendicularly to said camshaft between a lubricating oil sump and said regulator, said control shaft being operationally connected at an intermediate point thereof to said camshaft and having opposite ends respectively connected to said pump and said regulator for rotation thereof.

2. A control unit as claimed in claim 1, further comprising a power take-off above said regulator coaxially with said control shaft for connection with a mechanical tachometer.

* * * * *